US005964280A

United States Patent [19]

Wehrmann et al.

[11] Patent Number: 5,964,280

[45] Date of Patent: Oct. 12, 1999

[54] MULTIPLE FLUID PATH PLATE HEAT EXCHANGER

[75] Inventors: Reinhard Wehrmann, Reutlingen; Jim Patterson, Pliezhausen, both of Germany

[73] Assignee: Modine Manufacturing Company, Racine, Wis.

[21] Appl. No.: 08/882,125

[22] Filed: Jun. 25, 1997

[30] Foreign Application Priority Data

Jul. 16, 1996 [DE] Germany ..... 196 28 560
Jul. 16, 1996 [DE] Germany ..... 196 28 561

[51] Int. Cl.[6] ..... F28D 7/10

[52] U.S. Cl. ..... 165/140; 165/166; 165/167; 165/143; 165/145; 165/174

[58] Field of Search ..... 165/140, 145, 165/143, 166, 167, 160, 174, 175, 110, 112

[56] References Cited

U.S. PATENT DOCUMENTS

| | | | |
|---|---|---|---|
| 2,251,066 | 7/1941 | Persson et al. | 165/167 |
| 2,591,878 | 4/1952 | Rogers et al. | 165/167 |
| 3,240,268 | 3/1966 | Armes | 165/167 |
| 3,255,817 | 6/1966 | Davids et al. | 165/167 X |
| 3,532,161 | 10/1970 | Lockel | 165/167 |
| 4,002,201 | 1/1977 | Donaldson | 165/140 |
| 4,407,359 | 10/1983 | Berger et al. | 165/167 |
| 4,470,455 | 9/1984 | Sacca | 165/167 |
| 4,479,533 | 10/1984 | Persson et al. | 165/160 X |
| 4,976,313 | 12/1990 | Dahlgren et al. | 165/167 |
| 4,987,955 | 1/1991 | Bergqvist et al. | 165/167 |
| 5,462,113 | 10/1995 | Wand | 165/140 X |
| 5,538,077 | 7/1996 | So et al. | 165/140 X |

FOREIGN PATENT DOCUMENTS

| | | |
|---|---|---|
| WO94/29659 | 12/1994 | Germany . |
| WO95/35474 | 12/1995 | Germany . |

*Primary Examiner*—Christopher Atkinson
*Attorney, Agent, or Firm*—Wood, Phillips, VanSanten, Clark & Mortimer

[57] ABSTRACT

Space and weight constraints on heat exchangers performing heat exchange operations between three or more fluids are eliminated in a structure including a plurality of plates (10, 12) arranged in a stack (13). Collars (36, 38) about openings (30, 32) the plate (10, 12), divide the spaces between the plates (10, 12) into two different types of spaces (44, 46). A connecting flange (50) with a tube (46) and a separator element (64) cooperates with holes (54) and (56) within the plates that (10, 12) to isolate certain of the spaces (44) from other of the spaces (44) providing a means for flowing different heat exchange fluid through different ones of the spaces (44) while flowing still another heat exchange fluid through the spaces (46), all in a single structure.

17 Claims, 6 Drawing Sheets

MULTIPLE FLUID PATH PLATE HEAT EXCHANGER

FIELD OF THE INVENTION

This invention relates to a plate type heat exchanger formed of individual heat exchanger plates stacked upon one another with the spaces between adjacent plates defining flow channels and with rows of aligned holes or apertures in the plates to define inlet and outlet connections to the various channels.

BACKGROUND OF THE INVENTION

Plate type heat exchangers have long been popular for a variety of heat transfer applications, particularly in the vehicular field. In the usual case, a series of plates are stacked in spaced relation. The spaces between adjacent plates define flow channels for the heat transfer fluids. Typically, aligned rows of holes are disposed in the plates and through the use of separators and/or baffles, are caused to provide fluid communication to only certain of the flow channels. In a typical case, for a two fluid plate type heat exchanger, every other channel from top to bottom of the stack will receive a heating/cooling fluid while the channels at the interface between the heating/coolant channels receives the fluid to be subject to the heat transfer operation. In typical vehicular applications, the heating/coolant fluid is typically engine coolant while the fluid being subject to the heat transfer operation will typically be some sort of oil as, for example, engine lubricating oil, transmission oil, oil used in other hydraulic systems, or retarder oil.

As vehicles become more and more complex, there is an increasing need to provide for cooling of the oil of each of the many vehicular systems that employs oil. Plate heat exchangers of the type described previously have only two separate circuits, one for the coolant and one for the oil. Consequently, in a vehicle having several sources of oil requiring cooling, it is necessary to employ a separate heat exchanger for each source of oil. This, of course, adds to the complexity of the fluid system of the vehicle and furthermore adds weight, which impacts on fuel economy. Furthermore, each separate heat exchanger adds to the cost of the heat exchange system. Moreover, the use of several heat exchangers in such a situation requires a greater space within the vehicle to house the heat exchangers.

In an attempt to alleviate the problem is disclosed in WO document 95/35474. According to this disclosure, three separate circuits for three different fluids are integrated into a single heat exchanger. In an especially preferred embodiment of such a heat exchanger, only two differently formed heat exchanger plates are required. These are inserted into one another in a certain way and forms three separate flow channels. However, they must be rotated by 180 degrees and failure to do so will result in a defective heat exchanger. Furthermore, all of the heat exchanger plates have a total of six openings for the passage of fluids. As a result of such a large number of openings, the potential for leakage at joints is increased.

The present invention is directed to overcoming one or more of the above problems.

SUMMARY OF THE INVENTION

It is the principal object of the invention to provide a new and improved plate type heat exchanger. More specifically, it is an object of the invention to provide a new and improved plate type heat exchanger which is capable of simultaneously performing heat exchange operations on three, and preferably four or more different fluid streams.

An exemplary embodiment achieves the foregoing object in a plate type heat exchanger for exchanging heat between a multiplicity of at least three heat exchange fluids. The plate type heat exchanger includes a plurality of spaced plates which are secured together to form a pack having a plurality of fluid flow channels extending between adjacent plates. The channels of the plurality are divided into at least three groups and the channels in a first of the groups are spaced from one another by the channels of the other groups. Separate inlets and outlets are connected to the channels of each of the groups and consist of a maximum of four rows of aligned holes in the plates.

In a preferred embodiment, the inlet and outlet of one of the groups are located in the holes of two of the sets defining the inlet and outlet for another of said groups.

In a highly preferred embodiment, a tube defines the holes of the one set and is located generally centrally within the holes of another set and extends at least partially through the pack.

In one embodiment, a disk is sealed to the exterior of the tube and to two adjacent plates in the holes defining another set.

In a highly preferred embodiment, the plates are drawn plates and at least some of the holes includes collars sealingly engaging an adjacent plate.

The invention also contemplates the provision of imperforate baffles sealed to certain of the holes of both of the sets of holes defining the inlet and outlet for the first group of channels at identical locations within the pack.

According to another facet of the invention, there is further provided at least one adapter unit defining at least one of the inlets or one of the outlets. The adapter unit includes a connecting plate mounted to the stack, a flow element entering the stack, and a separator element separating the flow element from the channels of the other group of channels.

In a preferred embodiment, the flow element is a conduit having its exterior sealed to both the connecting plate and to the separator element.

Preferably, the separator element is also sealed to two adjacent plates defining a channel of the first group.

Other objects and advantages will become apparent from the following specification taken in connection with the accompanying drawings.

DESCRIPTION OF THE PREFERRED EMBODIMENTS

Figure 1:
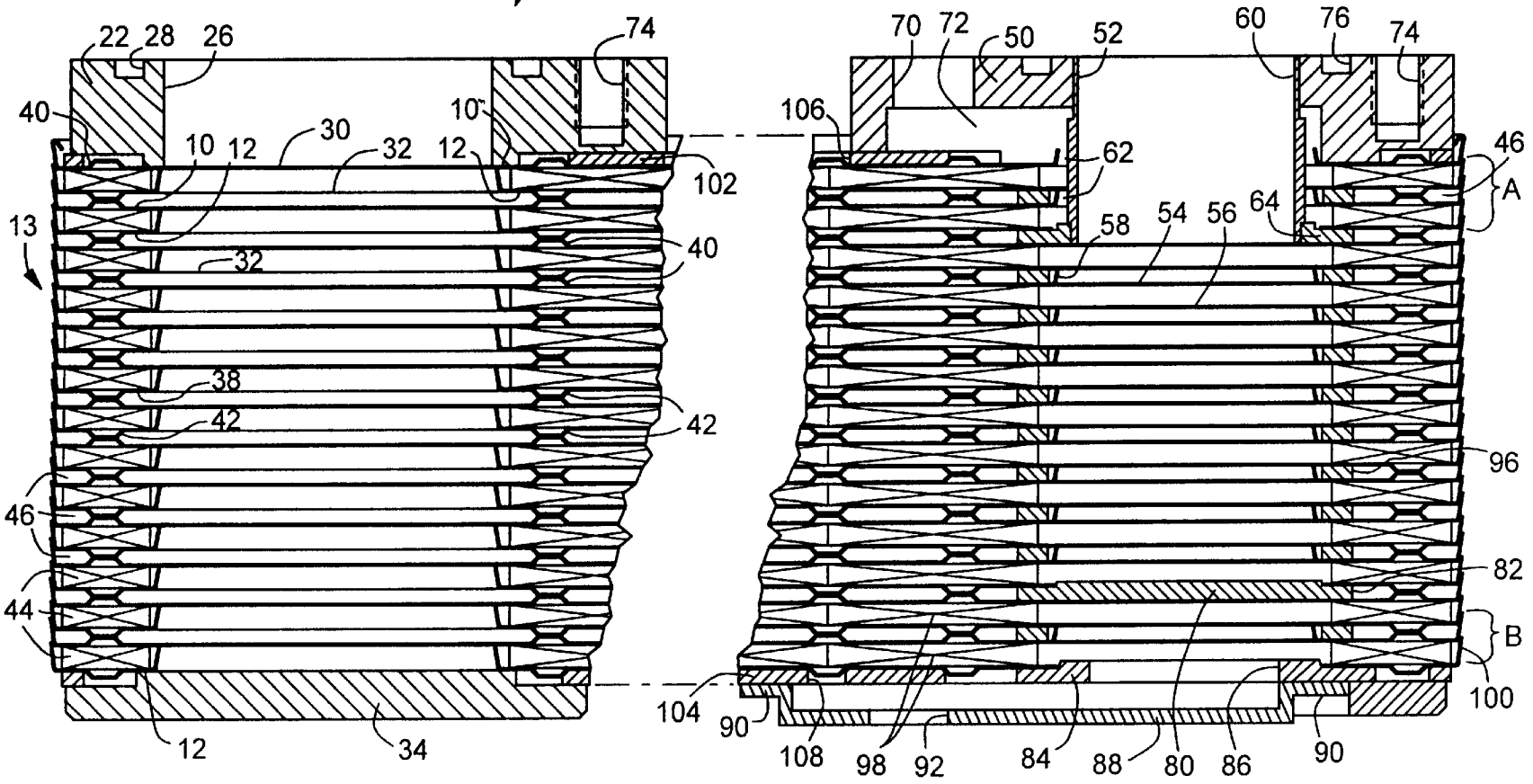
FIG. 1 is a sectional view of a heat exchanger made according to the invention as it would appear in sections taken along either one of the lines 1—1 in FIG. 2.
Figure 2:
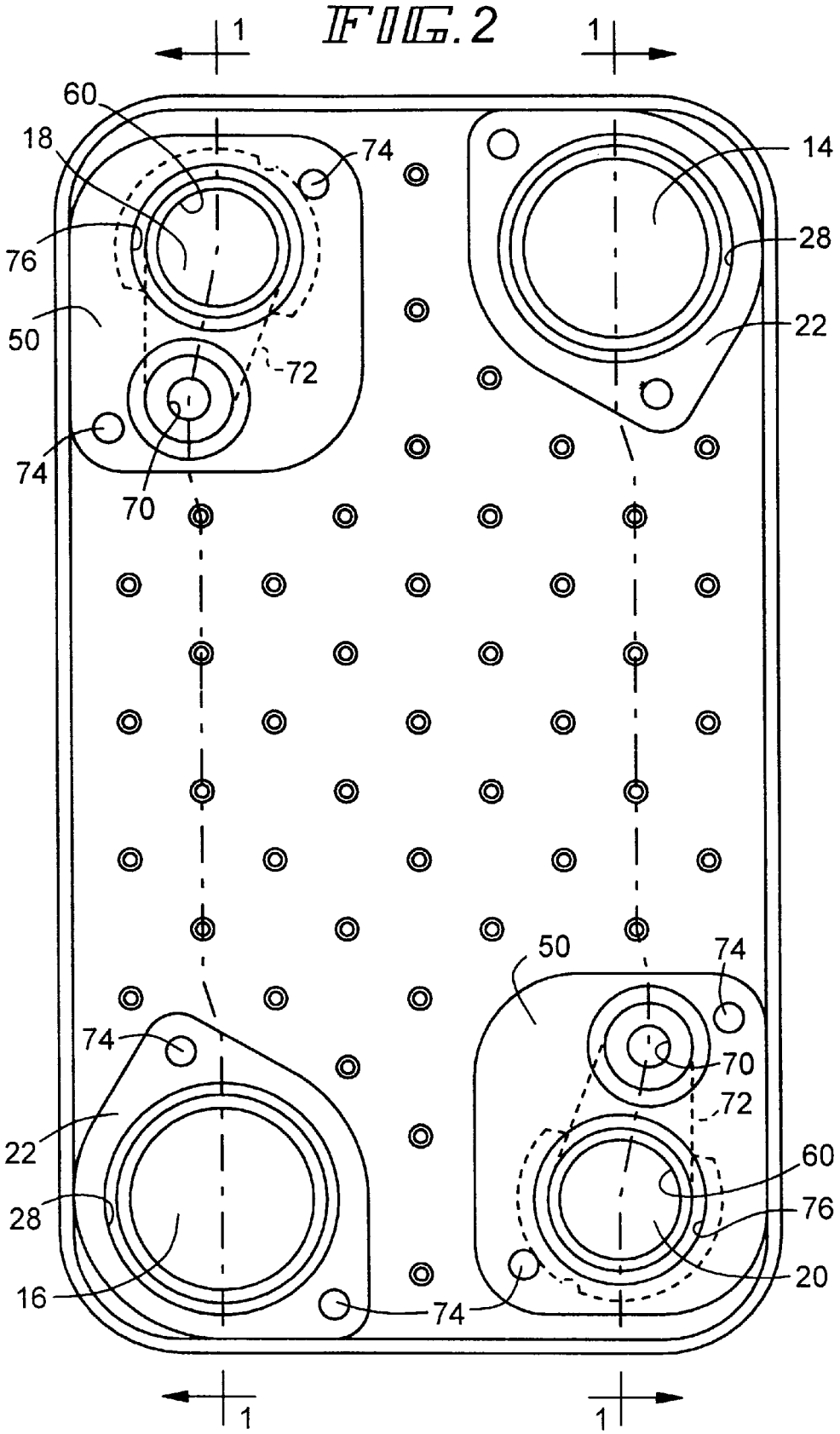
FIG. 2 is a plan view of the heat exchanger of FIG. 1.
Figure 3:
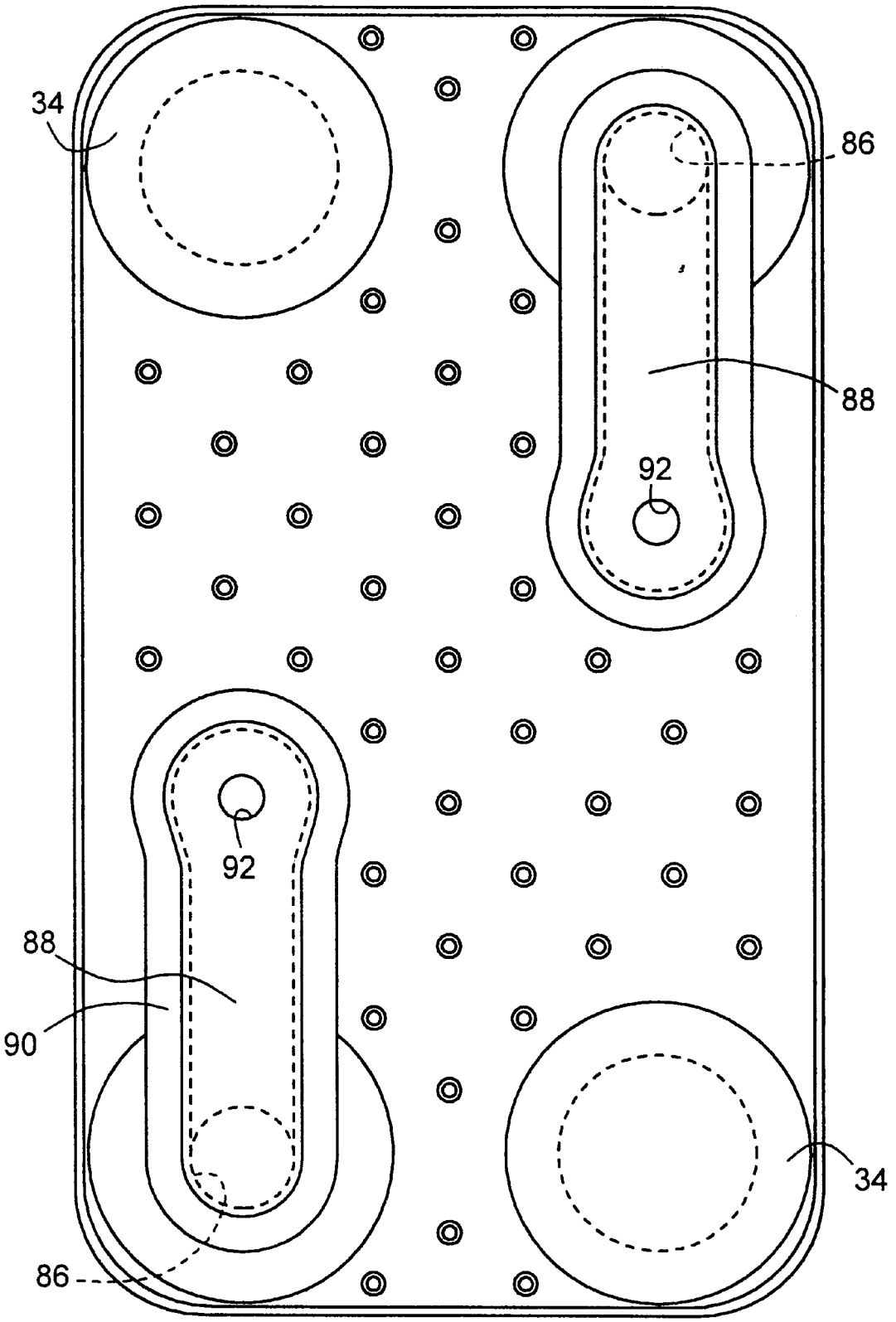
FIG. 3 is a bottom view of the heat exchanger of FIG. 1.

Referring to FIGS. 1–3, there is illustrated a plate type heat exchanger made up of a plurality of plates 10 and a plurality of plates 12. The plates are drawn or stamped in the configuration to be described and are assembled to form a stack, generally designated 13. Within the stack 13, the plates 10 and 12 are alternated with one of the plates 10 forming the top plate in the stack and one of the plates 12 forming the bottom plate in the stack.

As seen in FIG. 2, the plates 10 and 12 are generally rectangular and the construction at the upper right hand corner 14 is a mirror image of the construction at the lower left hand corner 16. Similarly, the construction at the upper left hand corner 18 is a mirror image of the construction shown at the lower right hand corner 20. As a consequence, only the constructions at the upper and lower left hand corners 18 and 16, respectively, will be described.

At the corner 16, a connecting flange 22 is located. The connecting flange 22 includes tapped bores by which any suitable fluid conducting fixture can be connected to the connecting flange 22. Generally centrally of the connecting flange 22 is a port 26 of circular shape. A groove 28 adapted to receive an 0-ring seal or the like surrounds the port 26.

Within the stack 13, each of the plates 10 and 12 includes respective openings 30 and 32 aligned with the port 26. The bottom most plate 12 in the stack includes an imperforate plug 34 in its opening 32.

The plates 10, about the openings 30, have downwardly and radially outwardly directed collars 36 which engage and seal against upwardly and radially inwardly directed collars 38 on the plates 12 surrounding the openings 32 therein. Further, the plates 10 have upwardly extending dimples 40 while the plates 12 have aligned, downwardly extending dimples 42. As can be readily appreciated, the collars 36 and 38 provide one means of spacing between the plates 10 and 12 while the dimples 40 and 42 engage each other and provide another means of spacing.

More specifically, the collars 30 and 32 provide spaces 44 between adjacent plates which are sealed from the port 26 by the interengagement of the collars 36 and 38. The dimples, on the other hand, provide spaces 46 which open to the holes 30, 32 in the plates 10, 12 and thus are open to the port 26. It will also be appreciated that the spaces 44, 46 alternate throughout the stack 13.

As mentioned previously, an identical construction is present at the corner 14. As a consequence, the connecting flange 22 at either location may be used as an inlet for a heat exchange fluid, typically an engine coolant, while the connecting flange 22 at the other corner may be used as an outlet. Fluid will flow into one of the ports 26 through the holes 30 and 32 to enter the spaces 46 and then flow between the plates 10 and 12 to the opposite corner where the connecting flange 22 serves as an outlet. During this flow, the spaces 44 are isolated by reason of the presence of the interengaging collars 36, 38.

Turning now to the corner 18, a connecting flange 50 is provided. The same includes a circular opening 52 that is aligned with holes 54 in the plates 10 and holes 56 in the plates 12. In the case of the holes 54 and 56, only the plates 10, about the holes 54, have collars 58 which project upwardly and somewhat radially inwardly.

Mounted within the opening 52 is a flow element in the form of a tube 60. The tube has an outside diameter somewhat smaller than the inside diameter of the collars 58 about the holes 54. Thus, a small gap 62 exists about the periphery of the tube 60 where it enters the stack 13.

At its lower end, tube 60 mounts a separator element 64 which extends radially outwardly to a location between two of the plates 10 and 12 at the space 46. A seal is established at this location during the assembly process as, for example, when the components are sealed or brazed together.

The connecting flange 50 also includes a port 70 which connects to a channel 72 which extends to the exterior of the tube 60. As a consequence, a heat exchange fluid may enter or leave the port 70 and flow through the channel 72 to or from the gap 62 to thereby enter the spaces 44 that are located above the separator element 64. Again, because the identical construction is employed at the corner 20, one of the ports 70 will serve as an inlet and the other may serve as an outlet for the two spaces 44 in the area designated A in FIG. 1.

The connecting flange 50 also includes a pair of tapped bores 74 for connection to a fixture as well as an O-ring receiving groove 76 concentric with the tube 60.

The openings 54 and 56 in the plates 10 and 1 2, near the bottom of the stack, are closed off by an imperforate baffle 80 having a periphery 82 that extends into one of the spaces 44 between the plates 10 and 12 and is sealed thereto to prevent fluid flow through the holes 54, 56 at its location. The baffle 80 isolates two of the spaces 44 from the remainder of the stack in an area designated "B" in FIG. 1. An annular disk 84 is located in the hole 56 in the lowermost plate 12 includes a central opening 86. An upwardly opening channel 88 has a peripheral flange 90 brazed to the bottom of the stack along with a port 92. The port 92 will thus be in fluid communication with the holes 54, 56 below the baffle 80, and thus with the spaces 44 at this location. Consequently, one of the ports 92 may be used as an inlet to the two spaces 44 in the zone "B" while the other may be used as an outlet.

If desired, annular disks or washers 96 may be located within the spaces 46 just radially outward of the collars 56. Turbulators are schematically shown at 98 and may be located within the spaces 44 if desired.

The heat exchanger is completed by a peripheral, upwardly and radially outwardly directed flange 100 about each of the plates 10 and 12. As is well known, the flanges 100 nest with one another as illustrated in FIG. 1 and seal against one another when the heat exchanger is assembled in a soldering or brazing operation.

For pressure resistance, relatively heavy gauge backing plates 102 at the top of the stack 13 and 104 at the bottom of the stack 13 may be employed. As can be appreciated from FIG. 1, the backing plates 102 may include apertures 106 adapted to receive the dimples 40 on the plate 10 to locate the components properly during assembly. Similarly, the plate 104 may include apertures 108 for receiving the dimples 42 on the lowermost plate 12 to perform the same function.

A consideration of the previously described structure will yield the conclusion that the heat exchanger shown in FIGS. 1–3 is capable of exchanging heat, simultaneously, between four different fluids. Although the heat exchanger is not restricted to vehicular use, it will find utility there and in such an environment, engine coolant will typically be flowed into and out of the ports 26 in the connecting flanges 22. As a consequence, coolant will be flowed to each of the spaces 46 within the stack 13.

Transmission oil, for example, may be flowed into and out of the tubes 60. As such, it will flow through the spaces 44 in all areas of the stack except those areas designated "A" and "B" by reason of the separating effect of the separator 64 and the baffle 80.

Retarder oil may be flowed through, for example, the ports 92 where it will pass into the spaces 44 between the plates in the region "B." Similarly, hydraulic fluid may be flowed into and out of the ports 70 to flow through the spaces 44 in the area "A."

In all cases, the oils will be in heat exchange relation with the engine coolant through the adjacent one of the plates 10 or 12 with isolation of the streams being maintained by the collars 36, 38, 58 or the washers 96 and/or separator 64 and the baffle 80.

Figure 4:
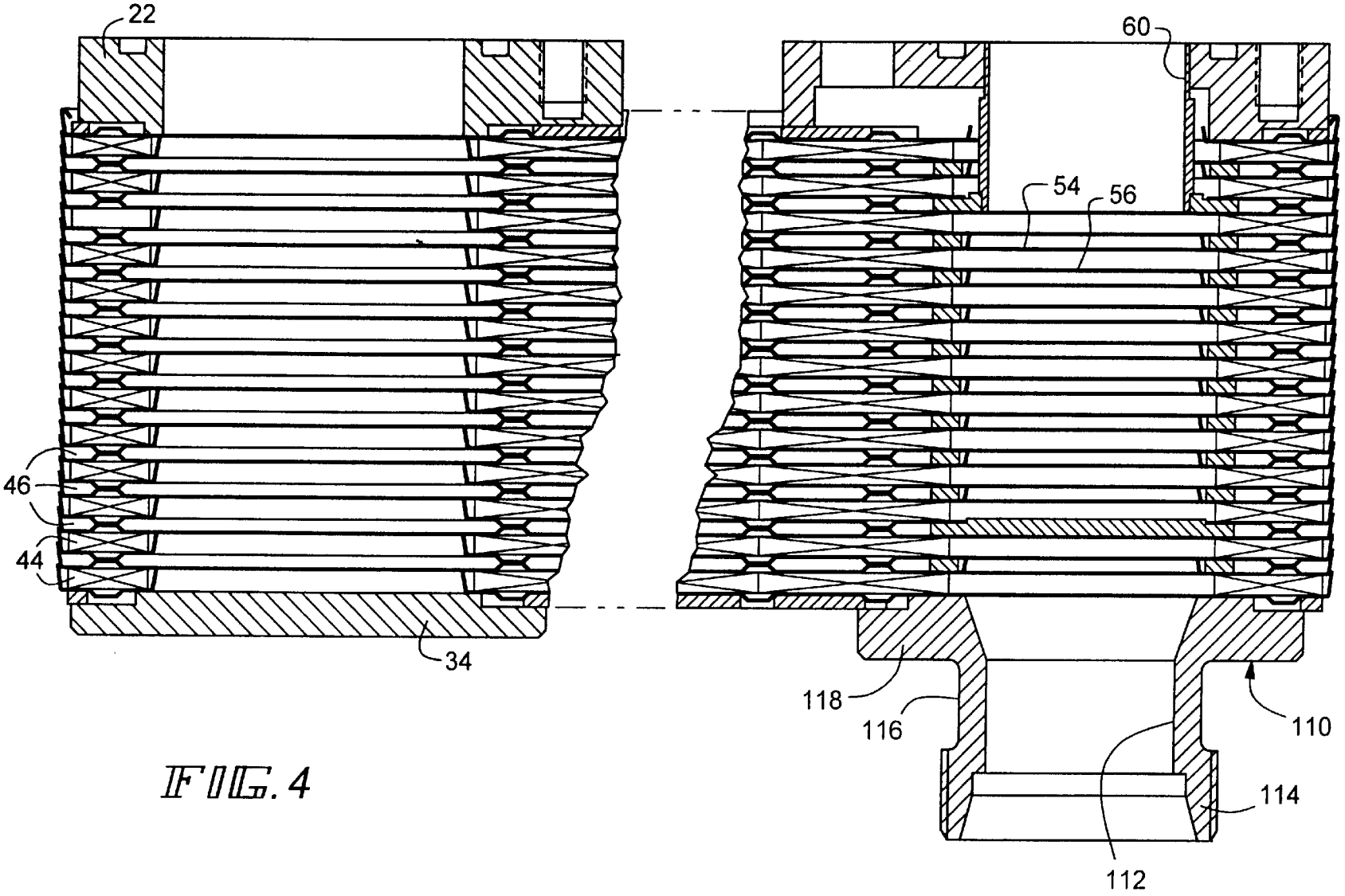
FIG. 4 is a view similar to FIG. 1 but of a modified embodiment of the invention.
Figure 5:
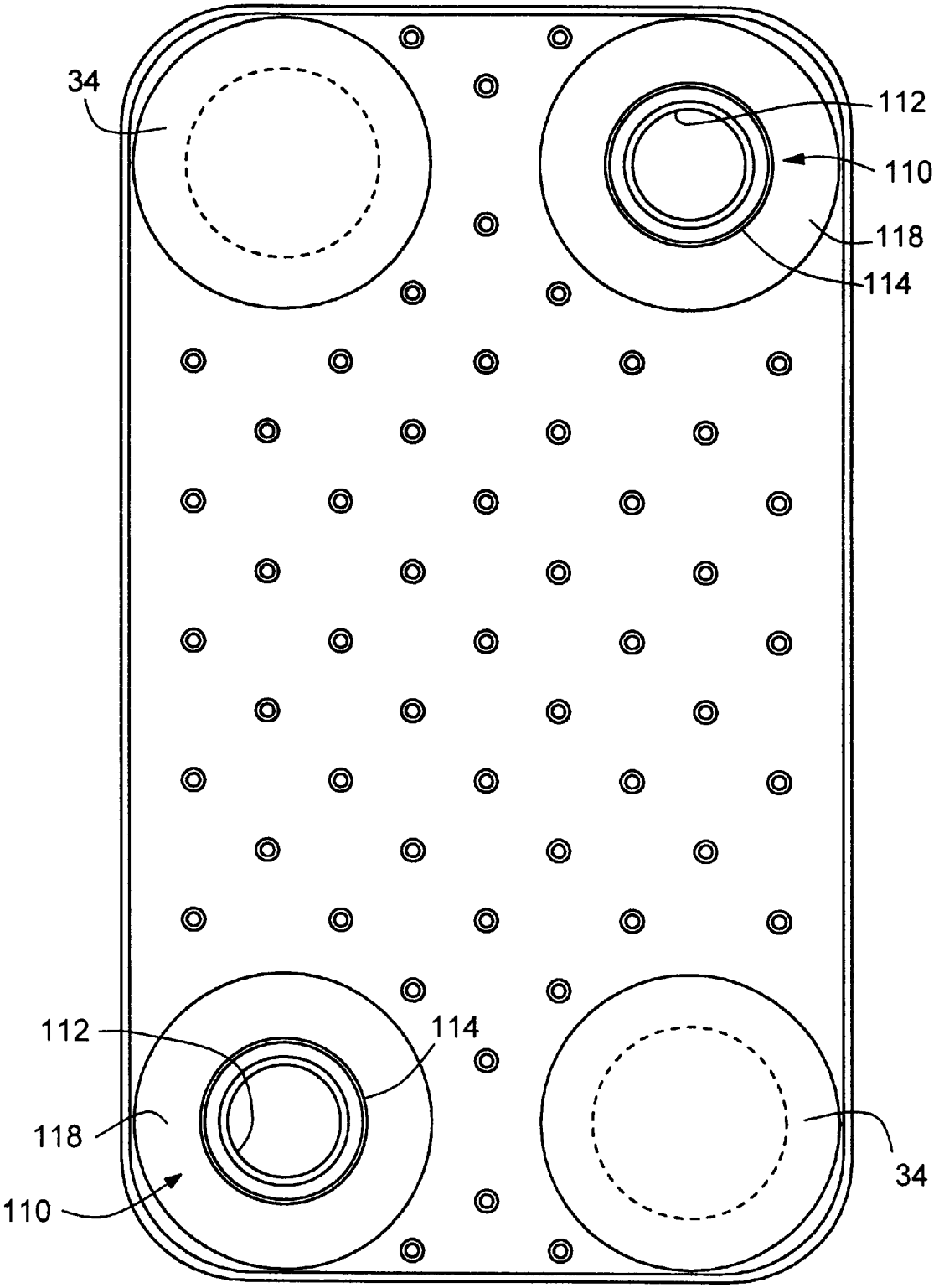
FIG. 5 is a bottom view of the embodiment of FIG. 4.

FIG. 4 illustrates a similar embodiment but where the channels 88 are dispensed with in favor of a nipple 110 brazed to the bottom of the stack in alignment with the openings 54, 56. The nipple 110 includes an interior conduit 112 and a peripheral lip 114 surrounded by a radially outwardly opening peripheral groove 116. A hose may be fitted over the lip 114 to abut the base 118 of the nipple 110 and a hose clamp tightened within the groove 116 to hold the hose in place.

Figure 6:
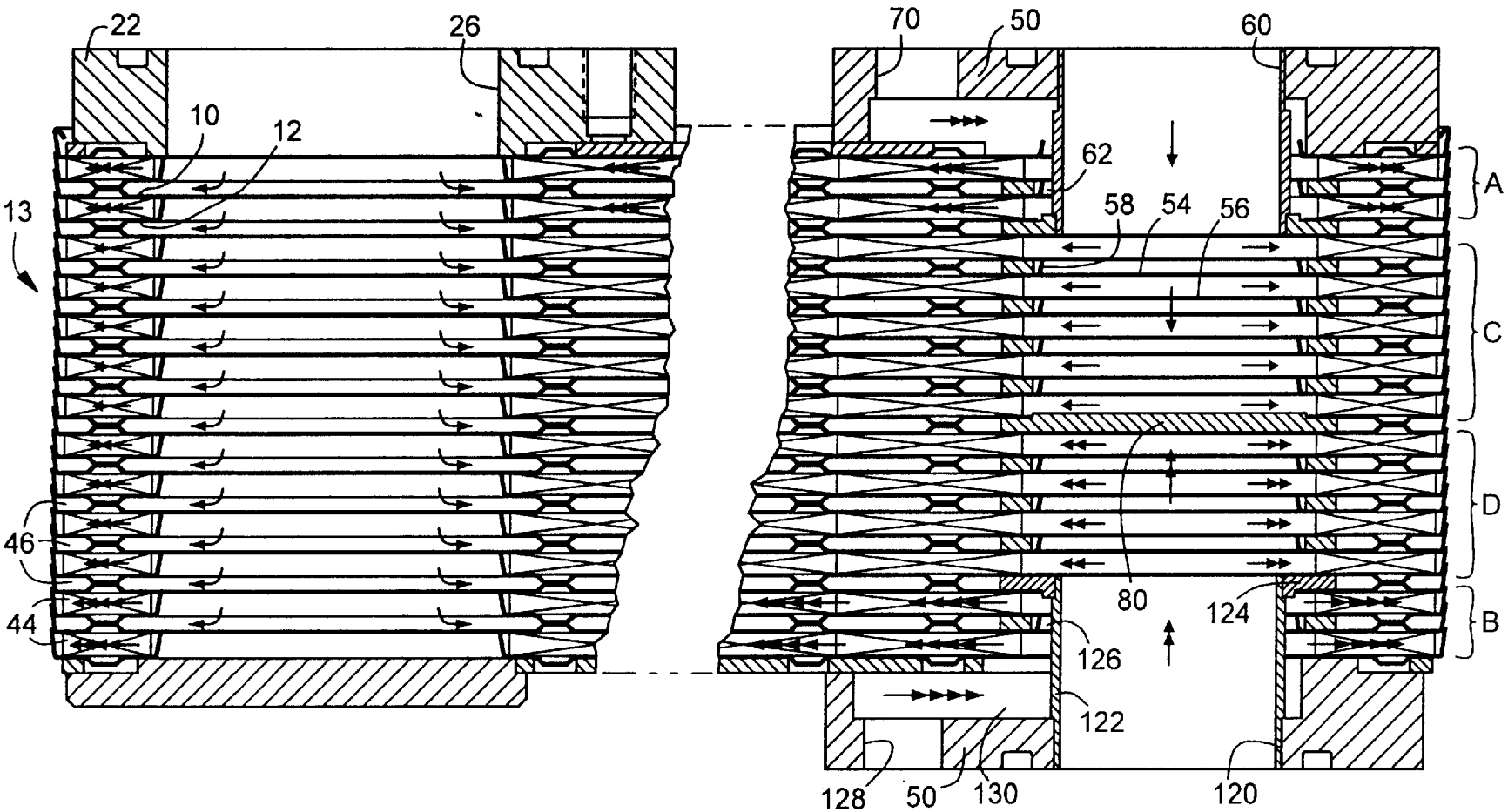
FIG. 6 is a sectional view similar to FIGS. 1 and 4 but of still a further modified embodiment of the invention.

FIG. 6 illustrates an embodiment of the invention that is operative to perform heat exchange operations between as many as five different fluids. In this embodiment, at the top of the stack 13, the connecting flanges 22 and 50 are retained and the structure is identical to that previously described. However, the baffle 80 is moved upwardly in the stack to a point approximately mid-way in the stack 13. The channels 88 are dispensed with in favor of third and fourth connecting flanges of the type shown at 50. As a consequence, at the lower end of the stack 13, a connecting flange 50 is located at each of the corners 14 and 16 and each include a bore 120 aligned with the holes 54, 56 and the plates 10, 12 at a location below the baffle 80. A tube 122 is located within the bore 120 and is essentially identical to the tube 60. It extends upward to a separator element 124 identical to the separator element 64 which is located in and sealed to one of the spaces 44 between the plates 10 and 12. Again, the outer diameter of the tube 122 is less than the inner diameter of the holes 54 and 56 and the collars 58 so that a gap 126 similar to the gap 62 is formed. A port 128 is located in the connecting flange and extends to a channel 130 which goes to the outer diameter of the tube 122. As a consequence, the port 128 is in fluid communication with the gap 126.

In this embodiment, a fluid, typically a coolant, will flow between the ports 26, that is, through the spaces 44 within the stack 13. Another heat exchange fluid may enter and leave the tubes 60 and thus will flow through spaces 46 below the region "A" and above the baffle 80. This region is designated "C" in FIG. 6.

A third fluid may enter and leave through the ports 70 and will flow through the spaces 46 within the region designated "A." A fourth fluid may enter and depart through the tubes 122 and thus will flow through the spaces 46 above the region "B" and below the baffle 80. This region is designated "D." The fifth fluid may enter and depart at ports 128 and thus will flow through the spaces 46 in the region "B." Consequently, the four fluids flowing through the tubes 60 or 122, or the ports 70 or 128 will all exchange heat with the fluid being flowed through the ports 26.

It will thus be appreciated that a plate type heat exchanger made according to the invention is advantageous in that it provides for the exchange of heat between three or more fluids in a single structure. As a consequence, the expense of separate heat exchangers for each heat exchange operation is avoided. Furthermore, spacial requirements to house the heat exchangers is reduced because a single heat exchanger assembly can be employed. Because only two types of plates are utilized, assembly is readily simple and inasmuch as the orientation of one plate to the other does not change even when the plates are rotated, manufacturing problems are minimized.

It will also be appreciated that the unique construction of the connecting flange 50 with the tubes 60, 122 and the separator elements 64, 124 provides the unique means of achieving the separation of multiple heat exchange fluids in a single heat exchanger.

We claim:

1. A plate type heat exchanger for exchanging heat between a multiplicity of at least three heat exchange fluids, comprising;

a plurality of spaced plates secured together to form a stack having a plurality of fluid flow channels extending between adjacent plates;

the channels of said plurality of fluid flow channels being divided into at least three groups;

the channels in a first of said groups being spaced from one another by channels of the other groups; and separate inlets and separate outlets connected to the channels of each of said groups, and consisting of a maximum of four sets of aligned holes in said plates.

2. The plate type heat exchanger of claim 1 wherein the inlet and outlet of one of said groups are located within the inlet and outlet defined by the holes of two of said sets.

3. The plate type heat exchanger of claim 2 wherein tubes define the inlet and outlet of said one group and are located generally centrally within the holes of said two of said sets another set and extend partially through said stack.

4. The plate type heat exchanger of claim 3 further including a disc sealed to the exterior of said tubes and to two adjacent plates in the holes of said two of said sets.

5. The plate type heat exchanger of claim 1 wherein said plates are drawn plates and at least some of said holes include collars sealingly engaging an adjacent plate.

6. The plate type heat exchanger claim 1 further including imperforate baffles sealed to the holes of two of said sets of holes defining the inlet and outlet for said first group of channels at identical locations within said stack.

7. The plate type heat exchanger of claim 1 further including at least one adapter unit defining at least one of said inlets or one of said outlets, said adapter unit comprising a connecting plate mounted to said stack, a flow element entering said stack and a separator element separating said flow element from the channels of said other groups of channels.

8. The plate type heat exchanger of claim 7 wherein said flow element is a conduit having its exterior sealed to both said connecting plate and said separator element.

9. The plate type heat exchanger of claim 8 wherein said separator element is also sealed to two adjacent plates defining a channel of said first group.

10. A plate type heat exchanger for exchanging heat between a multiplicity of at least three heat exchange fluids, comprising;

a plurality of spaced plates secured together to form a stack having a plurality of fluid flow channels extending between adjacent plates;

a plurality of aligned holes in said plates to define an inlet or an outlet; and a connecting adapter comprising a connecting plate mounted to said stack about one of said holes, a conduit mounted to said connecting plate and entering said stack through said aligned holes, said conduit being spaced from the peripheries of said holes to define a flow passage between said conduit and said peripheries of said holes, and a separator element sealed to said conduit and to two adjacent plates defining said channels.

11. The plate type heat exchanger of claim 10 further including a port in said connecting plate in fluid communication with said flow passage.

12. The plate type heat exchanger of claim 10 wherein said separator element is an annular disc having a generally central opening receiving said conduit and sealed thereto, said disc further including an outer periphery located between and sealed to said two adjacent plates.

13. The plate type heat exchanger of claim 10 wherein said conduit and said separator element are separate components bonded together.

14. The plate type heat exchanger of claim 10 wherein said conduit is a generally cylindrical tube and said holes are of circular cross section.

15. The plate type heat exchanger of claim 10 wherein said connecting plate includes tapped bores for receiving threaded fasteners to allow a fixture to be secured to said connecting plate.

16. A plate type heat exchanger comprising:

a plurality of plates in a stack having opposed ends and in spaced relation to one another, the spaces between adjacent plates defining at least four groups of channels;

the channels of a first of said groups being located throughout said stack between said ends with adjacent channels of said first group being spaced by a channel of another of the groups;

the channels of a second of said groups being located near one end of said stack;

the channels of a third of said groups being located near the other end of said stack;

the channels of said fourth group being located between the channels of said second and third groups;

four rows of aligned holes in said plates in spaced relation to one another;

first separators surrounding the holes in two of said rows at locations between adjacent ones of said plates defining said first group of channels;

second separators surrounding the holes in the remaining rows at locations between adjacent ones of said plates defining at least some of said second, third and fourth group of channels;

at least two of said second separators comprising imperforate discs blocking said remaining rows at a first location between said ends of said stack;

at least two of said second separators comprising a tube located within each of said remaining rows and spaced from the periphery of the holes thereof to defining a gap and an annular disc on the tube blocking said remaining rows at a second location between said ends of said stack;

said first location being at the interface of said fourth group and one of said second and third groups; and said second location being at the interface of said fourth group and the other of said second and third groups.

17. The plate type heat exchanger of claim 16 further including two connector plates mounted to said stack, each about a respective one of said remaining rows, said tubes being mounted to the associated connector plate and in fluid communication with a first port therein; and a second port in each connector plate in fluid communication with the gap about the associated tube.

* * * * *